US008661764B2

(12) United States Patent
Vemuri

(10) Patent No.: US 8,661,764 B2
(45) Date of Patent: Mar. 4, 2014

(54) METHOD OF FORMING MULTILAYERED NETLOCK GIRDER SYSTEM

(76) Inventor: Venkata Rangarao Vemuri, Hyderabad (IN)

( * ) Notice: Subject to any disclaimer, the term of this patent is extended or adjusted under 35 U.S.C. 154(b) by 1 day.

(21) Appl. No.: 13/197,796

(22) Filed: Aug. 4, 2011

(65) Prior Publication Data

US 2012/0137627 A1 Jun. 7, 2012

(51) Int. Cl.
*E04H 12/00* (2006.01)

(52) U.S. Cl.
USPC ..... 52/650.1; 52/695; 52/657; 52/665; 52/843

(58) Field of Classification Search
USPC ..... 52/633, 650.1, 650.2, 657, 665, 690, 52/693, 695, 837, 843
See application file for complete search history.

(56) References Cited

U.S. PATENT DOCUMENTS

| | | | | | |
|---|---|---|---|---|---|
| 777,742 | A * | 12/1904 | Parent | 52/694 |
| 1,536,717 | A * | 5/1925 | Krekel | 52/657 |
| 1,901,800 | A * | 3/1933 | Bushey | 52/695 |
| 2,392,674 | A * | 1/1946 | Lachman et al. | 52/837 |
| 2,455,217 | A * | 11/1948 | Borges | 52/695 |
| 4,047,352 | A * | 9/1977 | Sweet | 52/693 |
| 4,104,843 | A * | 8/1978 | Gilb | 52/693 |
| 4,416,102 | A * | 11/1983 | Peters | 52/692 |
| 4,872,299 | A * | 10/1989 | Troutner et al. | 52/693 |
| 6,634,153 | B1 * | 10/2003 | Peterson | 52/695 |
| 2005/0198802 | A1 * | 9/2005 | McPherson | 29/430 |
| 2011/0146193 | A1 * | 6/2011 | de la Chevrotiere | 52/653.1 |

FOREIGN PATENT DOCUMENTS

| | | | | |
|---|---|---|---|---|
| GB | 2011507 | A * | 7/1979 | E01D 15/12 |

* cited by examiner

*Primary Examiner* — Brian Glessner
*Assistant Examiner* — Brian D Mattei
(74) *Attorney, Agent, or Firm* — Shook Hardy & Bacon LLP

(57) ABSTRACT

A multilayered netlock girder system is disclosed. The system includes a plurality of brace members positioned in a predefined multilayered network pattern, whereby positioning the plurality of brace members in the predefined multilayered network pattern enable the formation of a rigid network between at least two chord members comprising a plurality of insertion provisions for enabling a secured insertion of the plurality of brace members into the at least two chord members, a plurality of structural interlocks formed as a result of predefined multilayered network pattern configured for a secured interlocking of the plurality of brace members together at the plurality of interlockable junctions.

11 Claims, 13 Drawing Sheets

METHOD OF FORMING MULTILAYERED NETLOCK GIRDER SYSTEM

TECHNICAL FIELD OF THE INVENTION

The present invention generally relates to a field of steel construction. More particularly the present invention is related to a lattice girder system.

BACKGROUND OF THE INVENTION

Commonly, lattice girders are adopted in steel construction for various purposes. The lattice girders are used for trusses, girders for buildings, industrial structures and bridges, launching girders and the like.

Typically, lattice members are joined together by rivets/welding/bolting in lattice girders. The rivets have become obsolete. Welding and bolting are in vague.

Generally, conventional lattice girders/trusses involve heavy sections of great lengths. Due to such great lengths, the slenderness ratio is high requiring large sections. Fabrication and erection of lattice girders require extensive member cutting, shaping, joining and elaborate in situ works.

A diagram depicting a town lattice truss patented in years 1820 and 1835 illustrated in FIG. 1 is of an orthogonal pattern with bolted connections.

Hence there exists a need for a system and a method to achieve an optimized multilayered network for an optimal distribution of forces, loads and efficient utilization of material in a girder for enabling an ease of fabrication, reduced connections and which is simple and faster for erection.

BRIEF SUMMARY OF THE INVENTION

The objective of the present invention is to provide a system and a method for a multilayered netlock girder to achieve a lock pattern system through a predefined multilayered network of arranging members which arrests movements of members relative to each other.

Another objective of the present invention is to provide a movement restricting mechanism at intersections using preformed interlocks.

Another objective of the present invention is to reduce the section for conventional lower and upper chord members.

Another objective of present invention is to provide an easy connectionless interlocks in the netlock girder system at intersections which avoid physical connection resulting into no in situ welding.

Another objective of the present invention is to provide universal rotatable interlocks that can use various shapes and sizes of members.

Still another objective of the present invention is to provide universal, fixed interlocks for connecting members meeting at various angles, using various shapes and sizes of members Yet another objective of the present invention is to provide interlocks for enabling an ease of erection and ease of dismantling.

Still another objective of the present invention is to provide multiple interlocks for reducing the member effective lengths.

Accordingly, another objective of the present invention is to induce a self-locking girder system using the system used for inducing precompression.

Another objective is to allow smooth transition of forces at intersections to make stresses nearly axial.

Another objective of the present invention is to provide an optimal distribution of forces and efficient utilization of material in a girder.

Accordingly, another object of the present invention is to provide an economical and elegant alternative to the conventional lattice girder system.

A system and method for a multilayered netlock girder are disclosed. According to a first aspect of a present invention, a system for multilayered netlock girder includes a predefined multilayered network pattern.

According to the first aspect of the present invention, the system for multilayered netlock girder includes a plurality of brace members positioned in the predefined multilayered network pattern, whereby positioning the plurality of brace members in the predefined multilayered network pattern enable the formation of a plurality of interlockable junctions.

According to the first aspect of the present invention, the system for multilayered netlock girder includes at least two chord members comprising a plurality of insertion provisions for enabling a secured insertion of the plurality of brace members into the at least two chord members. The at least two chord members includes an upper chord member and a lower chord member. At least two vertical members mechanically coupled to the upper chord member and the lower chord member.

According to the first aspect of the present invention, the system for multilayered netlock girder includes a plurality of structural interlocks configured for a secured interlocking of the plurality of brace members together at the plurality of interlockable junctions. The plurality of structural interlocks including at least one of: a structural joint; and at least one structural plate with a plurality of structural tubes. The structural joint includes a plurality of structural openings for enabling a passage of the plurality of brace members. The plurality of brace members passing through the plurality of structural openings of the structural joint securely interlock together at the plurality of interlockable junctions. The plurality of structural tubes are mechanically coupled to the at least one structural plate. The plurality of brace members passing through the plurality of structural tubes securely interlock together at the plurality of interlockable junctions. The plurality of structural interlocks comprising at least one of a rotatable interlock and a fixed interlock.

According to a second aspect of a present invention, a system for multilayered netlock girder includes a plurality of brace members positioned in a predefined multilayered network pattern, whereby positioning the plurality of brace members in the predefined multilayered network pattern enables the formation of a rigid network.

According to the second aspect of the present invention, the system for multilayered netlock girder includes at least two chord members comprising a plurality of insertion provisions for enabling a secured insertion of the plurality of brace members into the at least two chord members.

According to a third aspect of a present invention, a method for multilayered netlock girder includes enabling a plurality of brace members of a predefined multilayered network pattern to form a plurality of interlockable junctions.

According to the third aspect of the present invention, the method for multilayered netlock girder includes providing a plurality of insertion provisions on at least two chord members, whereby the plurality of brace members are securely inserted into the at least two chord members.

According to the third aspect of the present invention, the method for multilayered netlock girder includes secure interlocking of the plurality of brace members together at the plurality of interlockable junctions by a plurality of structural interlocks. A step of interlocking the plurality of the brace members together at the plurality of interlockable junctions by at least one of a structural joint and a plurality of structural tubes with at least one structural plate. A step of passing the plurality of brace members through a first structural opening of the structural joint and a second structural opening of the structural joint securely interlock together at the plurality of interlockable junctions. A step of passing the plurality of brace members through a first structural tube and a second structural tube securely interlock together at the plurality of interlockable junctions.

BRIEF DESCRIPTION OF THE DRAWINGS

Other objects and advantages of the present invention will become apparent to those skilled in the art upon reading the following detailed description of the preferred embodiments, in conjunction with the accompanying drawings, wherein like reference numerals have been used to designate like elements, and wherein.

DETAILED DESCRIPTION OF THE INVENTION

Figure 1:
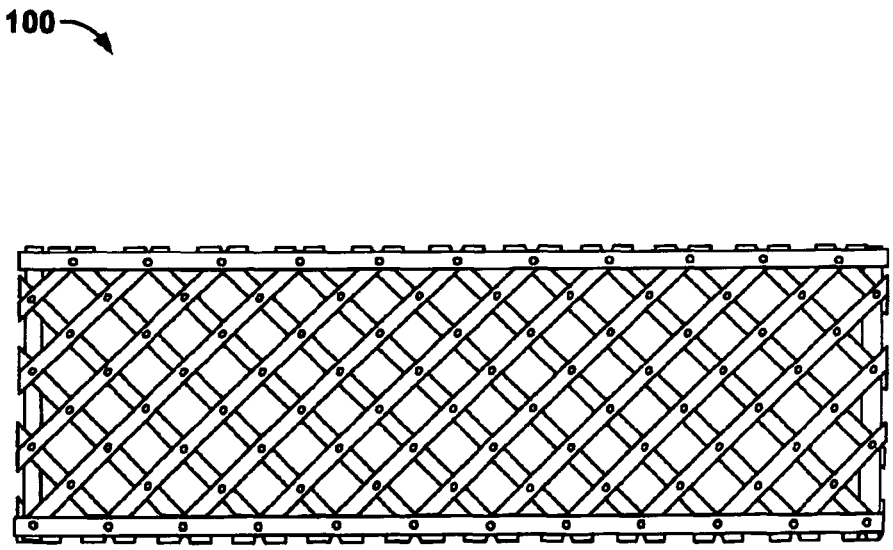
FIG. 1 PRIOR ART
FIG. 1 is a diagram depicting a town lattice truss as per published data

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting.

The use of "including", "comprising" or "having" and variations thereof herein is meant to encompass the items listed thereafter and equivalents thereof as well as additional items. The terms "a" and "an" herein do not denote a limitation of quantity, but rather denote the presence of at least one of the referenced item. Further, the use of terms "first", "second", and "third", and the like, herein do not denote any order, quantity, or importance, but rather are used to distinguish one element from another.

A system and method for a multilayered netlock girder are disclosed. According to a first aspect of a present invention, a system for multilayered netlock girder includes a predefined multilayered network pattern.

According to the first aspect of the present invention, the system for multilayered netlock girder includes a plurality of brace members positioned in a predefined multilayered network pattern, whereby positioning the plurality of brace members in the predefined multilayered network pattern enables the formation of a plurality of interlockable junctions.

According to the first aspect of the present invention, the system for multilayered netlock girder includes at least two chord members comprising a plurality of insertion provisions for enabling a secured insertion of the plurality of brace members into the at least two chord members. The at least two chord members includes an upper chord member and a lower chord member. At least two vertical members mechanically coupled to the upper chord member and the lower chord member.

According to the first aspect of the present invention, the system for multilayered netlock girder includes a plurality of structural interlocks configured for a secured interlocking of the plurality of brace members together at the plurality of interlockable junctions. The plurality of structural interlocks including at least one of: a structural joint; and at least one structural plate with a plurality of structural tubes. The structural joint includes a plurality of structural openings for enabling a passage of the plurality of brace members. The plurality of brace members passing through the plurality of structural openings of the structural joint securely interlock together at the plurality of interlockable junctions. The plurality of structural tubes mechanically coupled to the at least one structural plate. The plurality of brace members passing through the plurality of structural tubes securely interlock together at the plurality of interlockable junctions. The plurality of structural interlocks comprising at least one of: a rotatable interlock; and a fixed interlock.

According to a second aspect of a present invention, a system for multilayered netlock girder includes a plurality of brace members positioned in a predefined multilayered network pattern, whereby positioning the plurality of brace members in the predefined multilayered network pattern enable to form a rigid network.

According to the second aspect of the present invention, the system for multilayered netlock girder includes at least two chord members comprising a plurality of insertion provisions for enabling a secured insertion of the plurality of brace members into the at least two chord members.

According to a third aspect of a present invention, a method for multilayered netlock girder includes enabling a plurality of brace members of a predefined multilayered network pattern to form a plurality of interlockable junctions.

According to the third aspect of the present invention, the method for multilayered netlock girder includes providing a plurality of insertion provisions on at least two chord members, whereby the plurality of brace members securely inserted into the at least two chord members.

According to the third aspect of the present invention, the method for multilayered netlock girder includes secure interlocking of the plurality of brace members together at the plurality of interlockable junctions by a plurality of structural interlocks. A step of interlocking the plurality of the brace members together at the plurality of interlockable junctions by at least one of a structural joint and a plurality of structural tubes with at least one structural plate. A step of passing the plurality of brace members through a first structural opening of the structural joint and a second structural opening of the structural joint securely interlock together at the plurality of interlockable junctions. A step of passing the plurality of brace members through a first structural tube and a second structural tube securely interlock together at the plurality of interlockable junctions.

Figure 2:
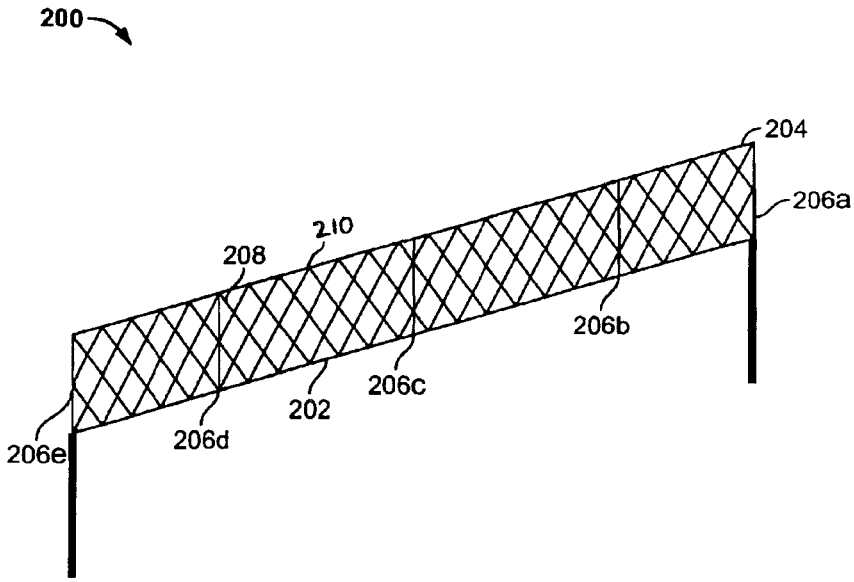
FIG. 2 is a diagram depicting an assembly of lock pattern girder system without interlocks.

Referring to FIG. 2, a diagram 200 depicting an assembly of netlock girder system without interlocks is illustrated. In accordance with a non limiting exemplary embodiment of the present invention, a system for a netlock girder includes a lower chord member 202, an upper chord member 204, multiple vertical members 206*a*, 206*b*, 206*c*, 206*d* and 206*e* and multiple staggered brace members 208.

In accordance with an exemplary embodiment of the present invention, the multiple brace members 208 are staggered and positioned in a predefined network pattern between the upper chord member 204 and the lower chord member 202, whereby positioning the multiple brace members 208 in the predefined network pattern enable to form a rigid network. The multiple vertical members 206*a*, 206*b*, 206*c*, 206*d* and 206*e* are bolted to the upper chord member 204 and the lower chord member 202. According to exemplary aspects of the present invention the multiple vertical members 206*a*, 206*b*, 206*c*, 206*d* and 206*e* are optional. The lower chord member 202, the upper cord member 204, vertical members 206*a* and 206*e* include multiple insertion provisions 210 for a secure insertion of the multiple staggered brace members 208 into the lower cord member 202 and the upper chord member 204 and vertical members 206*a* and 206*e* to avoid physical connections.

Figure 3:
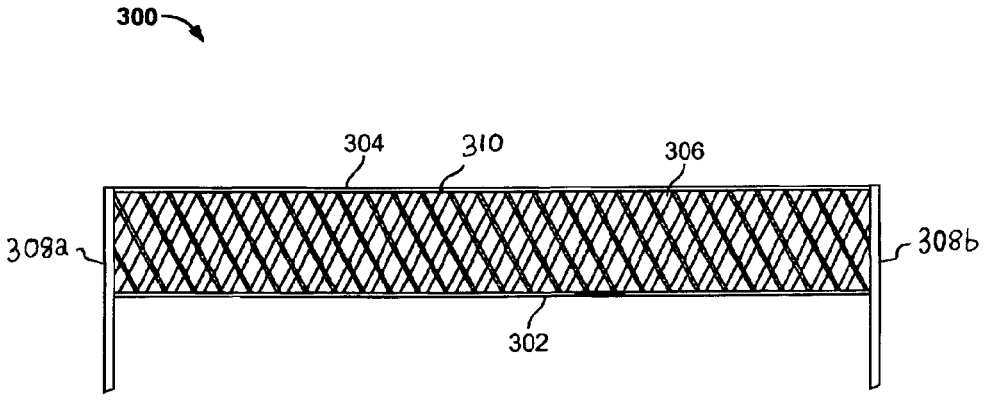
FIG. 3 is a diagram depicting an assembly of multilayered lock pattern girder system without interlocks.

Referring to FIG. 3 is a diagram 300 depicting an assembly of multilayered netlock girder system without interlocks. In accordance with a non limiting exemplary embodiment of the present invention, a system for multilayered netlock girder includes a lower chord member 302, an upper chord member 304, multiple brace members 306 and multiple vertical members 308*a* and 308*b* vertical members 308*a* and 308*b*.

In accordance with an exemplary embodiment of the present invention, the multiple brace members 306 are positioned in a predefined multilayered network pattern between the upper chord member 304 and the lower cored member 302, whereby positioning the multiple brace members 308 in the predefined multilayered network pattern enable to form a rigid network. The lower chord member 302, the upper chord members 304 include multiple insertion provisions 310 for a secured insertion of the multiple brace members 306 into the lower chord member 302 and the upper chord member. The multiple vertical members 308*a* and 308*b* are bolted to the upper chord member 304 and the lower chord member 302. According to exemplary aspects of the present invention the multiple vertical members 308*a* and 308*b* are optional.

Figure 4:
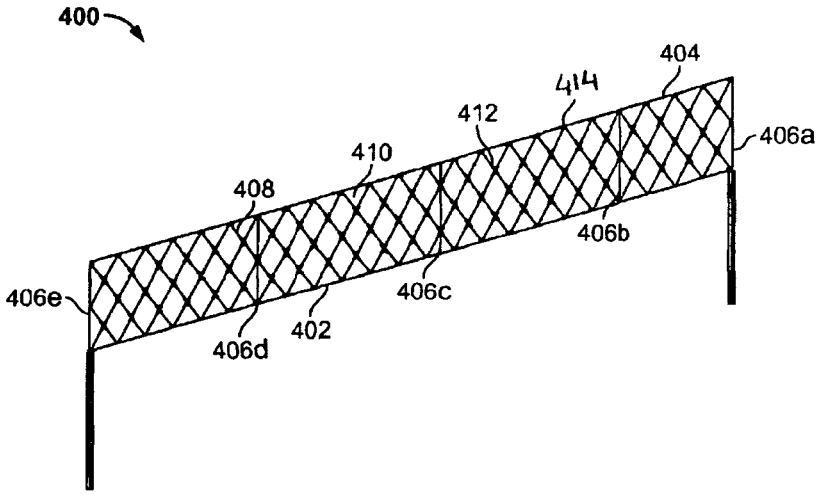
FIG. 4 is a diagram depicting an elevated assembly of netlock girder system with interlocks.

Referring to FIG. 4, a diagram 400 depicting an elevated assembly of netlock girder system with interlocks is illustrated. In accordance with a non-limiting exemplary embodiment of the present invention, a system for a netlock girder includes a lower chord member 402, an upper chord member 404, multiple vertical members 406*a*, 406*b*, 406*c*, 406*d* and 406*e* multiple brace members 408, multiple interlockable junctions 410 and multiple structural interlocks 412.

In accordance with an exemplary embodiment of the present invention, multiple vertical members 406*a*, 406*b*, 406*c*, 406*d* and 406*e* are bolted to the upper chord member 404 and the lower chord member 402. The multiple brace members 408 are positioned in a predefined network pattern between the upper chord member 404 and the lower chord member 402, whereby positioning the multiple brace members 408 in the predefined network pattern enable to form multiple interlockable junctions 410. The lower chord member 402 and the upper cord member 404 include multiple insertion provisions 414 for a secure insertion of the multiple brace members 408 into the lower chord member 402 and the upper chord member 404 and vertical members 406*a* and 406*e*.

According to a non-limiting exemplary embodiment of the present invention, the multiple structural interlocks 412 are configured to provide a secured interlocking of the multiple brace members 408 together at the multiple interlockable junctions 410. This avoids physical connections.

Figure 5A:
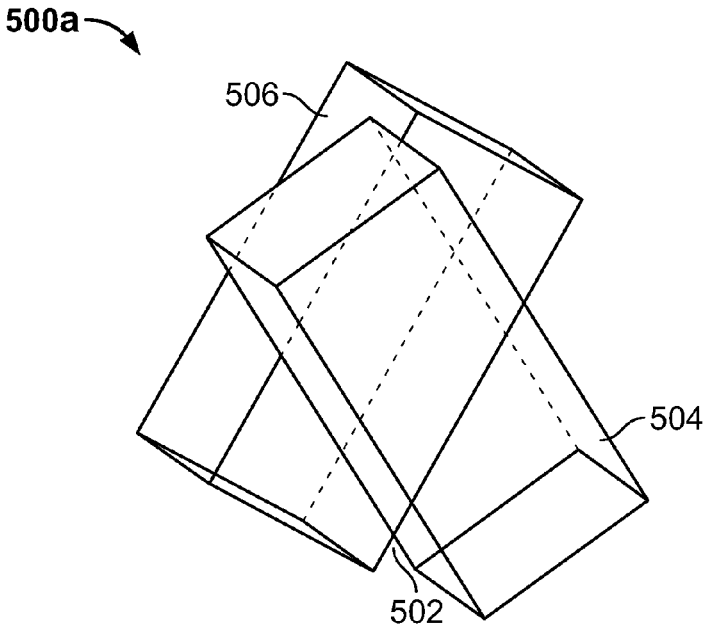
FIG. 5*a* is a diagram depicting an interlocking of brace members using a structural joint which includes hollow tubes without a gap between the brace members.

Referring to FIG. 5*a*, a diagram 500*a* depicting an interlocking of brace members using a structural joint which includes hollow tubes without a gap between the brace members is illustrated. In accordance with a non-limiting exemplary embodiment of the present invention, the interlocking of brace members using a structural joint which includes hollow tubes without a gap between the brace members depicts a structural joint 502, a first hollow tube 504 and a second hollow tube 506.

In accordance with an exemplary embodiment of the present invention, the structural joint 502 includes the first hollow tube 504 and the second hollow tube 506 for providing a passage of the multiple brace members. The multiple brace members pass through the first hollow tube 504 of the structural joint 502 and the second hollow tube 506 of the structural joint 502 for a secure interlock at an interlockable junction.

Figure 5B:
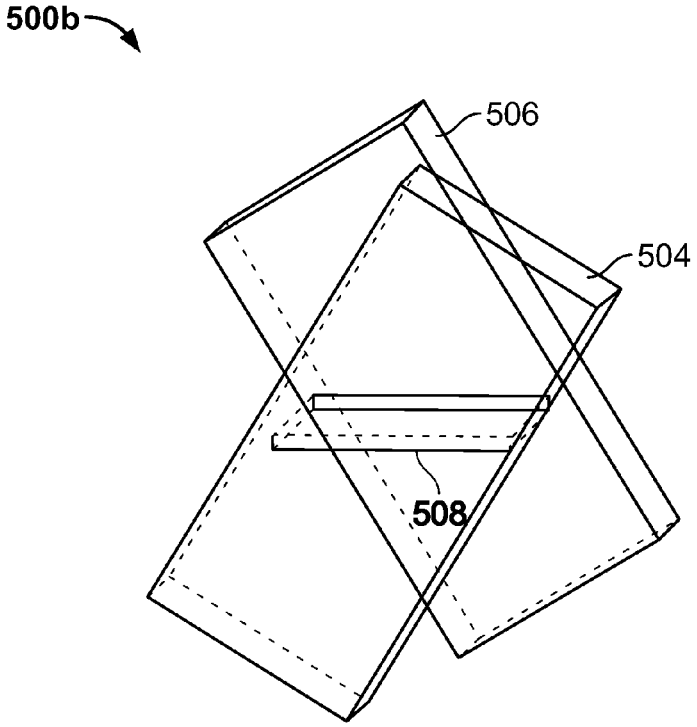
FIG. 5*b* is a diagram depicting an interlocking of brace members using hollow tubes with a horizontal plate with a gap between the brace members.

Referring to FIG. 5*b*, a diagram 500*b* depicting an interlocking of brace members using hollow tubes with a horizontal plate with a gap between the brace members is illustrated. In accordance with non-limiting exemplary embodiment of the present invention, the interlocking of brace members using hollow tubes with a horizontal plate with a gap between the brace members depicts a first hollow tube 504 and a second hollow tube 506 and a horizontal plate 508.

In accordance with an exemplary embodiment of the present invention, the horizontal plate 508 welded between the first hollow tube 504 and the second hollow tube 506. Multiple brace members pass through the first hollow tube 504 and the second hollow tube 506 for securely interlocking at multiple interlockable junctions.

Figure 5C:
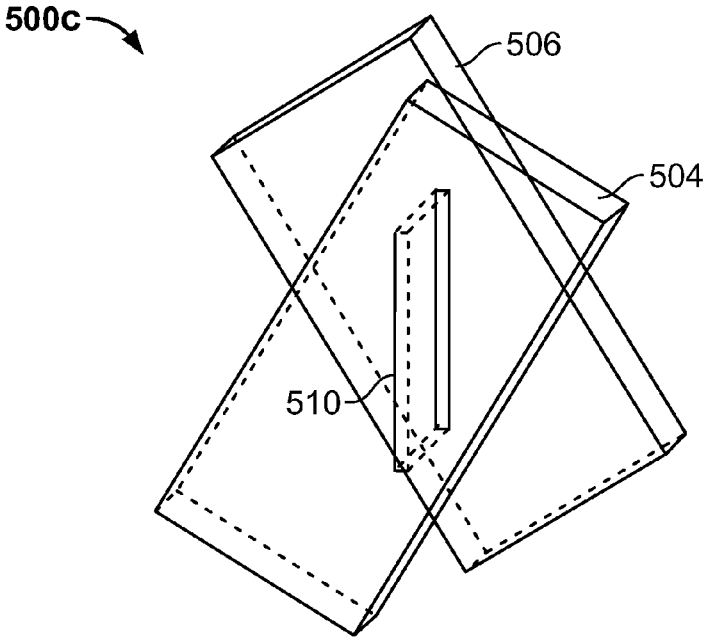
FIG. 5*c* is a diagram depicting an interlocking of brace members using hollow tubes with a vertical plate with a gap between the brace members.

Referring to FIG. 5*c*, a diagram 500*c* depicting an interlocking of brace members using hollow tubes with a vertical plate with a gap between the brace members is illustrated. In accordance with non-limiting exemplary embodiment of the present invention, the interlocking of brace members using hollow tubes with a vertical plate with a gap between the brace members depicts a first hollow tube 4504 and a second hollow tube 506 and a vertical plate 510.

In accordance with an exemplary embodiment of the present invention, the vertical plate 510 is welded between the first hollow tube 504 and the second hollow tube 506. Multiple brace members pass through the first hollow tube 504 and the second hollow tube 506 for securely interlocking at multiple interlockable junctions.

Figure 5D:
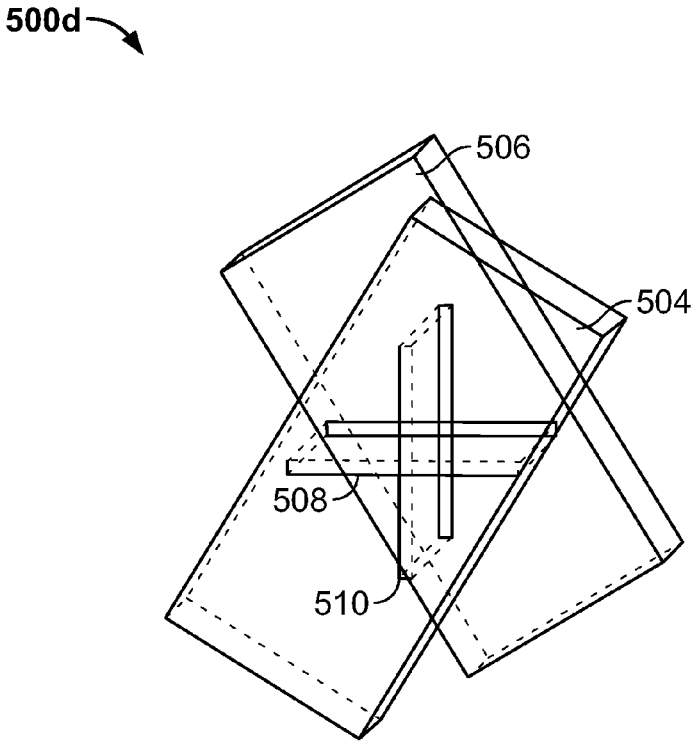
FIG. 5*d* is a diagram depicting an interlocking of brace members using hollow tubes with a horizontal plate and a vertical plate with a gap between the brace members.

Referring to FIG. 5*d*, a diagram 500*d* depicting an interlocking of brace members using hollow tubes with a horizontal plate and a vertical plate with a gap between the brace members is illustrated. In accordance with non-limiting exemplary embodiment of the present invention, the interlocking of brace members using hollow tubes with a horizontal plate and a vertical plate with a gap between the brace members depicts a first hollow tube 504 and a second hollow tube 506, a horizontal plate 508 and a vertical plate 510.

In accordance with an exemplary embodiment of the present invention, the horizontal plate 508 and the vertical plate 510 are welded between the first hollow tube 504 and the second hollow tube 506. Multiple brace members pass through the first hollow tube 504 and the second hollow tube 506 to securely interlock at multiple interlockable junctions.

Figure 6:
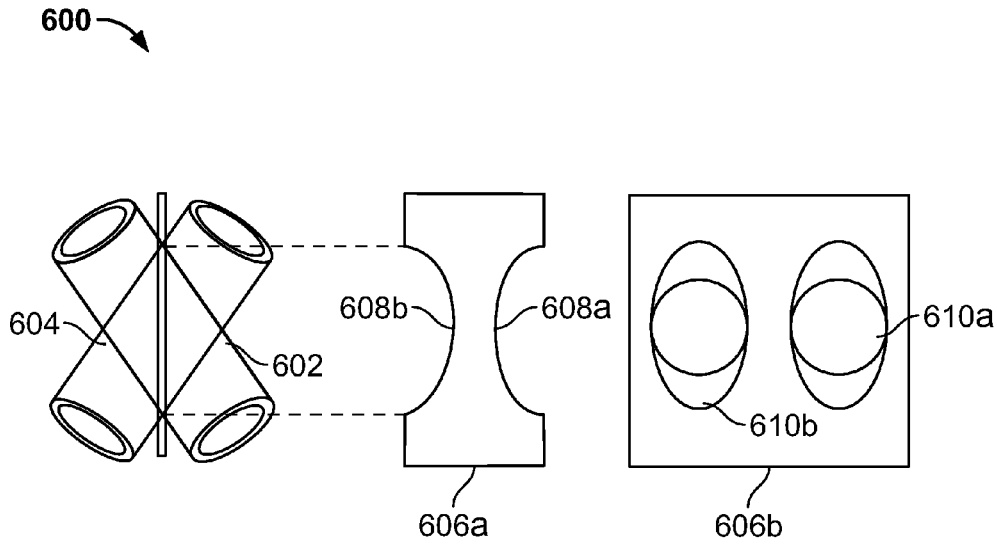
FIG. 6 is a diagram depicting an interlocking of brace members using circular tubes with a structural plate with a gap between the brace members.

FIG. 6 is a diagram 600 depicting an interlocking of brace members using circular tubes with a structural plate with a gap between the brace members. In accordance with a non-limiting exemplary embodiment of the present invention, the interlocking of brace members using circular tubes with a structural plate with a gap between the brace members depicts a first circular tube 602, a second circular tube 604 and structural plate 606*a* and 606*b*, semi-elliptical insertion provisions 608*a* and 608*b* and elliptical insertion provisions 610*a* and 610*b*.

In accordance with an exemplary embodiment of the present invention, the structural plate 606*a* includes the semi elliptical provisions 608*a* and 608*b* welded between the first circular tube 602 and the second circular tube 604 for a secure interlocking of the multiple brace members together at an interlockable junction or the first circular tube 602 and the second circular tube 604 are inserted and welded to the elliptical insertion provisions 610*a* and 610*b* of the structural plate 606*b* for a secured interlocking of the multiple brace members together at the interlockable junction. The multiple brace members pass through the first circular tube 602 and the second circular tube 604 to securely interlock at the interlockable junction.

Figure 7:
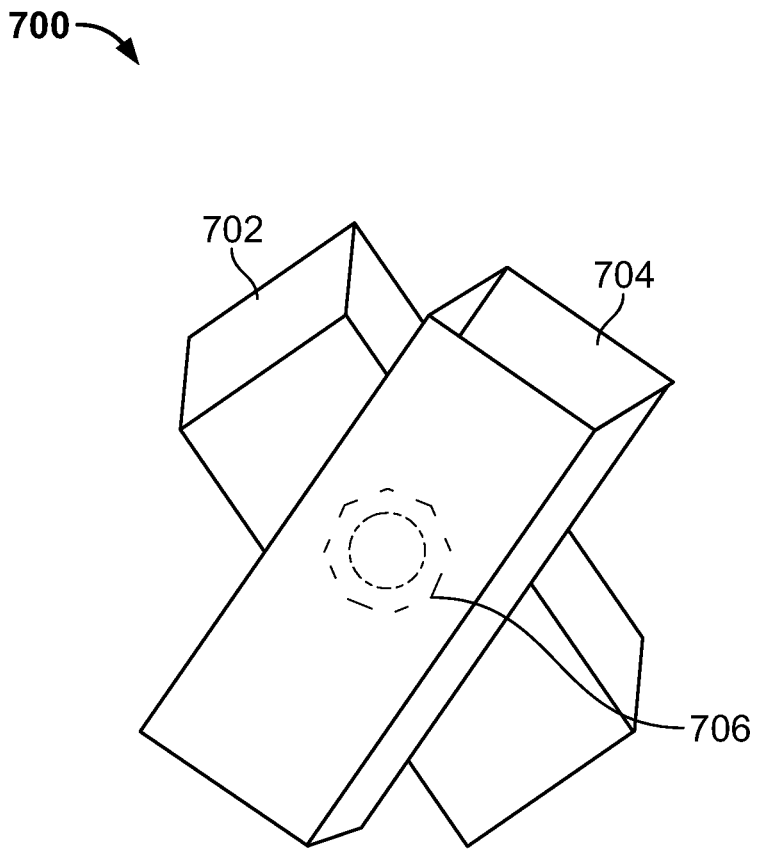
FIG. 7 is a diagram depicting an interlocking of brace members using rotatable interlock.

Referring to FIG. 7, a diagram 700 depicting an interlocking of brace members using rotatable interlock with a gap between brace members is illustrated. In accordance with a non-limiting exemplary embodiment of the present invention, the interlocking of brace members using rotatable interlock with a gap between brace members includes a first structural tube 702, a second structural tube 704 and rotatable interlock 706.

In accordance with an exemplary embodiment of the present invention, the first structural tube 702 and the second structural tube 704 are interconnected by rotatable interlock 706 to allow rotation of the first structural tube 702 and the second structural tube 704.

According to a non-limiting exemplary embodiment of the present invention, multiple brace members pass through the first structural tube 702 and the second structural tube 704 to securely interlock at an interlockable junction.

Figure 8:
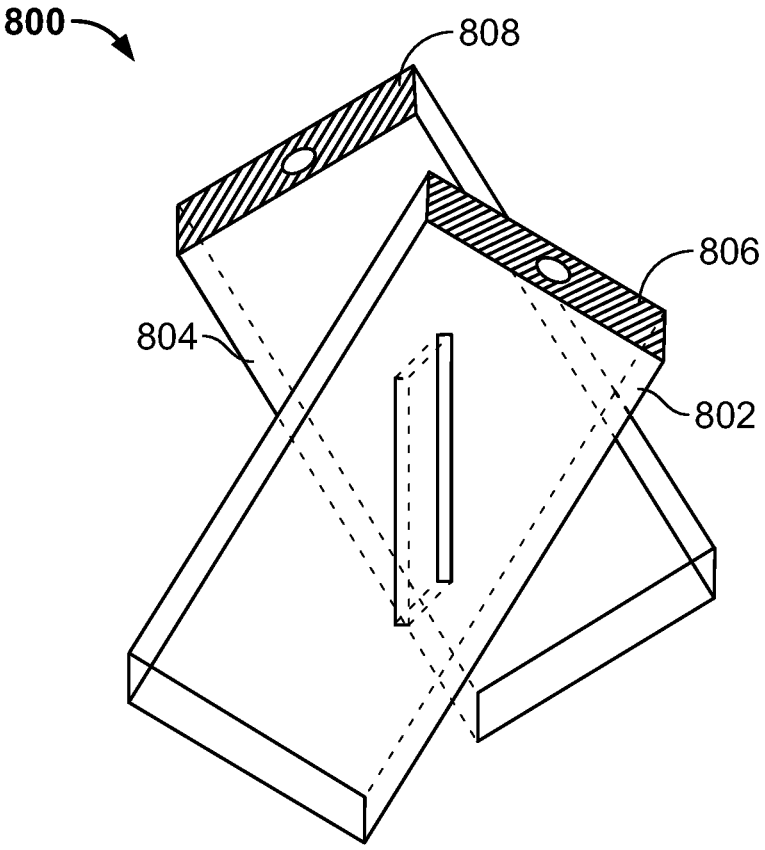
FIG. 8 is a diagram depicting universal interlocks for using predefined structural brace members.

Referring to FIG. 8, a diagram 800 depicting universal interlocks for using predefined structural brace members is illustrated. In accordance with a non-limiting exemplary embodiment of the present invention, the universal interlock for using predefined structural brace members includes a first hollow tube 802, a second hollow tube 804, a first structural plate 806 and a second structural plate 808.

In accordance with an exemplary embodiment of the present invention, the first hollow tube 802 welded with the first structural plate 806 of required shape in accordance with the shape of brace members and the second hollow tube 804 welded with the second structural plate 808 of a required shape in accordance with the shape of brace members for a passage of predefined structural brace members which are interlocked together. The predefined structural brace members pass through the first structural plate 806 of the first hollow tube 802 and the second hollow tube 804 of the second structural plate 808 to securely interlock at an interlockable junction.

Figure 9:
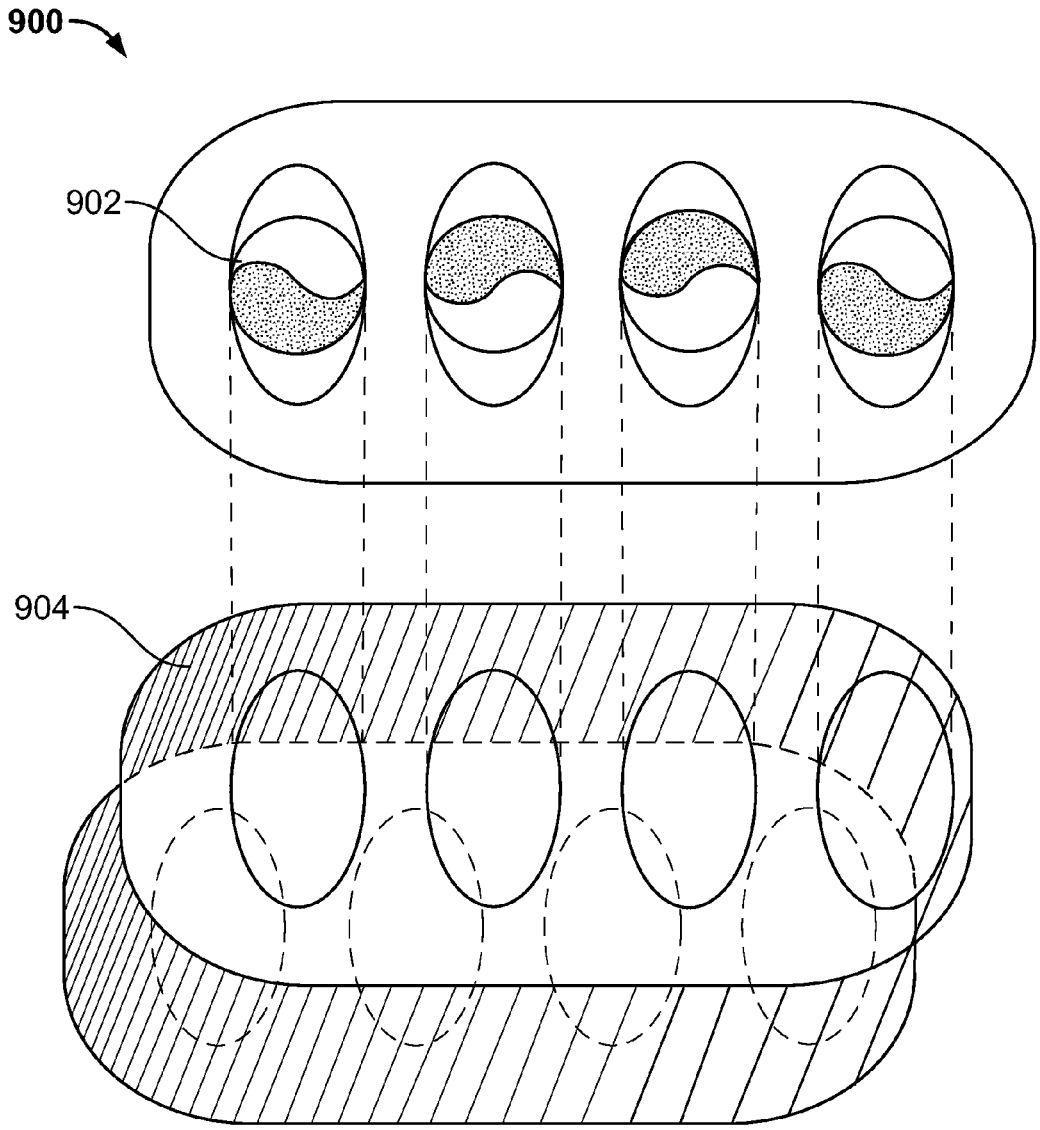
FIG. 9 is a diagram depicting multilayered interlocking of brace members using structural plate with multiple structural tubes.

Referring to FIG. 9, a diagram 900 depicting multilayered interlocking of a brace members using structural plate with multiple structural tubes is illustrated. In accordance with a non-limiting exemplary embodiment of the present invention, the multilayered interlocking of brace members using structural plate with multiple structural tubes includes multiple structural openings 902, a 4D assembly of structural plate 904.

In accordance with an exemplary embodiment of the present invention, the 4D assembly of structural plate 904 includes structural openings 902 on a top surface and a bottom surface. The multiple structural tubes inserted and welded to the multiple structural openings 902 of the 4D assembly of structural plate 904 for providing a passage of the multiple brace members. The multiple brace members pass through the multiple structural tubes to a secure interlock at an interlockable junction.

Figure 10A:
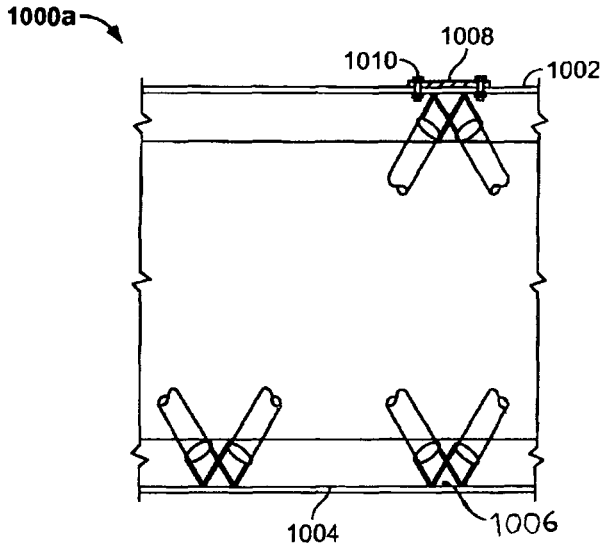
FIG. 10*a* is a diagram depicting an elevated assembly of multilayered netlock girder system.

Referring to FIG. 10, a diagram 1000*a* depicting an elevated assembly of multilayered netlock girder system is illustrated. In accordance with a non-limiting exemplary embodiment of the present invention, the elevated assembly of multilayered lock pattern girder system depicts an upper chord member 1002, a lower chord member 1004, multiple brace insertions 1006, a plate 1008 and bolts 1010.

In accordance with an exemplary embodiment of the present invention, the multiple brace insertions 1006 are attached to the upper chord member 1002 and lower chord member 1004. The multiple brace members are inserted into the multiple brace insertions 1006. The plate 1008 is attached to the upper chord member through bolt to securely lock the brace members.

Figure 10B:
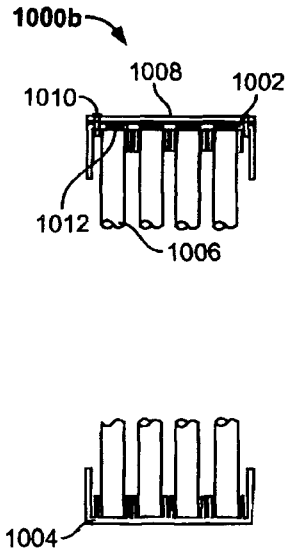
FIG. 10*b* is a diagram depicting a cross sectional view of multilayered netlock girder system.

Referring to FIG. 10*b*, a diagram 1000*b* depicting a cross-sectional view of multilayered netlock girder system is illustrated. In accordance with a non-limiting exemplary embodiment of the present invention, the cross section view of multilayered lock pattern girder system depicts an upper chord member 1002, a lower chord member 1004, multiple brace insertions 1006, a plate 1008, bolts 1010 and multiple insertion provisions 1012.

In accordance with an exemplary embodiment of the present invention, the multiple brace insertions 1006 are attached to the upper chord member 1002 and lower chord member 1004. The multiple brace members are inserted into the multiple brace insertions 1006. The upper chord member includes multiple insertion provisions 1012 for inserting the multiple brace members. The plate 1008 is attached to the upper chord member through bolt to securely lock the brace members.

Figure 10C:
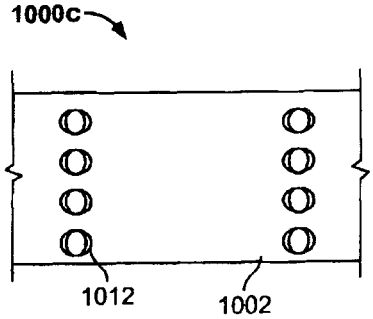
FIG. 10*c* is a diagram depicting insertion provisions on upper chord member of multilayered lock pattern girder system

Referring to FIG. 10*c*, a diagram 1000*c* depicting provisions on upper chord member of multilayered lock pattern girder system is illustrated. In accordance with a non-limiting exemplary embodiment of the present invention, the provision on upper chord member of multilayered lock pattern girder system depicts an upper chord member 1002 and multiple provisions 1012. The upper chord member includes multiple insertion provisions 1012 for inserting multiple brace members.

Figure 11A:
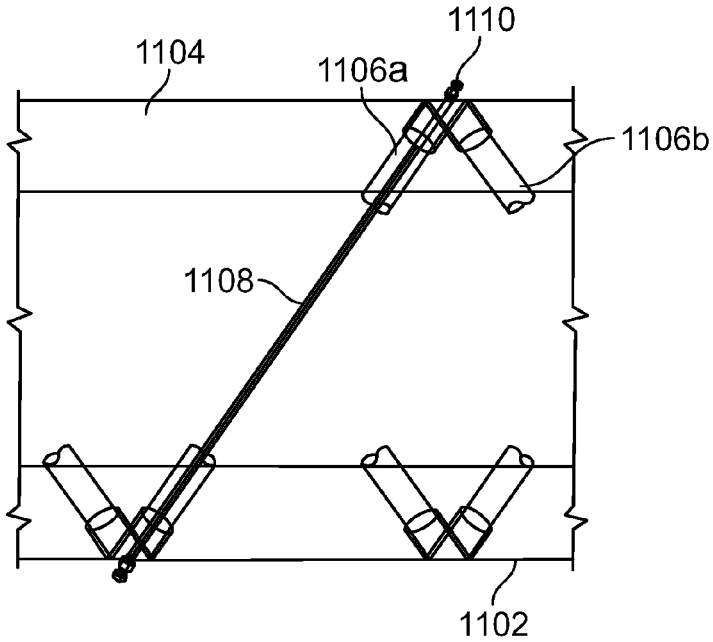
FIG. 11*a* is a diagram depicting an elevated assembly with a bolted tie rod of multilayered netlock girder system.

Referring to FIG. 11*a*, a diagram 1100*a* depicting an elevated assembly with a bolted tie rod of multilayered netlock girder system is illustrated. In accordance with a non-limiting exemplary embodiment of the present invention, the elevated assembly with a bolted tie rod of multilayered netlock girder system depicts a lower chord member 1102, an upper chord member 1104, multiple brace members 1106*a* and 1106*b*, tie rod 1108, and a bolt 1110.

In accordance with an exemplary embodiment of the present invention, the multiple brace member 1106*a* and 1106*b* are positioned in a predefined multilayered network pattern between the upper chord member 1104 and the lower chord member 1102. The tie rod 1108 is taken through the brace member 1106*a* and bolted to the upper chord member 1104 by a bolt 1110 and the lower chord member to lock the structural system in its position.

Figure 11B:
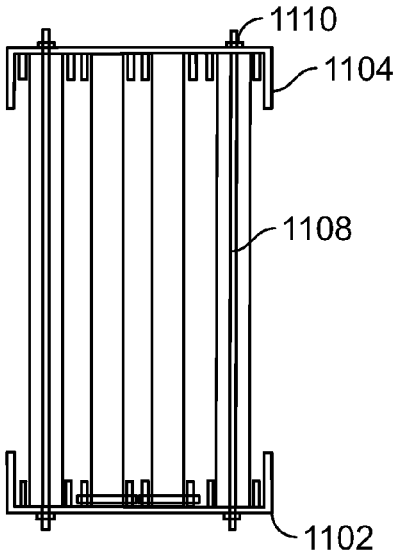
FIG. 11*b* is a diagram depicting a cross section view of a bolted tie rod of multilayered netlock girder system.

Referring to FIG. 11*b*, a diagram 1100*b* depicting a cross-sectional view of a bolted tie rod multilayered netlock girder system is illustrated. In accordance with a non-limiting exemplary embodiment of the present invention, the cross sectional views of a bolted tie rod multilayered netlock girder system depict a lower chord member 1102, an upper chord member 1104, a tie rod 1108 and a bolt 1110.

Figure 12A:
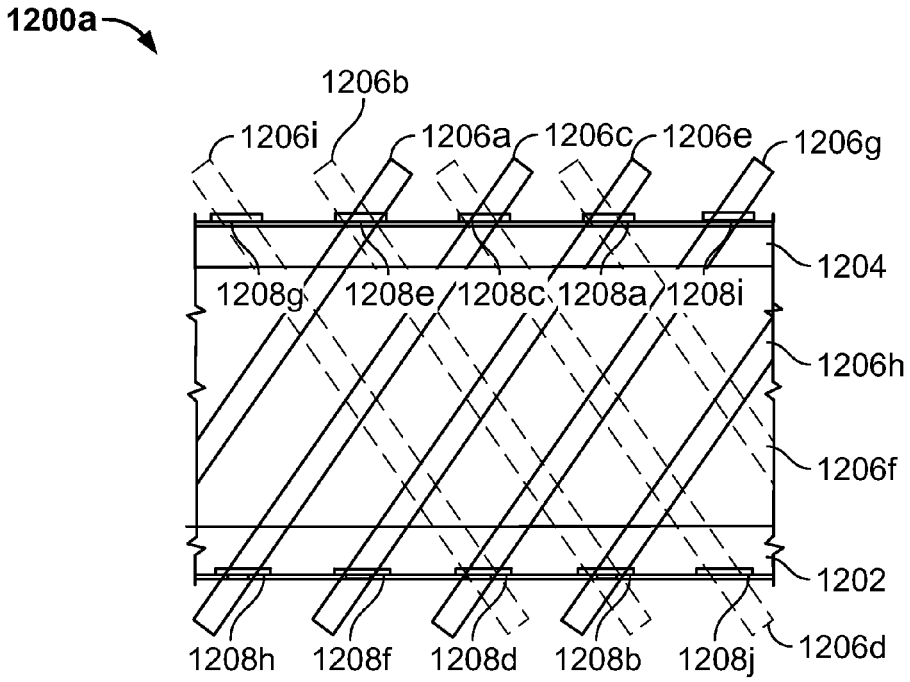
FIG. 12*a* is a diagram depicting an elevated assembly with multiple brace members welded with multiple holding plate of multilayered netlock girder system

Referring to FIG. 12*a*, a diagram 1200*a* depicting an elevated assembly with multiple brace members welded with multiple holding plate of multilayered netlock girder system is illustrated. In accordance with a non-limiting exemplary embodiment of the present invention, the elevated assembly with multiple brace members welded with multiple holding plate of multilayered netlock girder system depicts a lower chord member 1202, a upper chord member 1204, multiple brace members 1206*a* and 1206*b*, 1206*c*, 1206*d*, 1206*e*, 1206*f*, 1206*g*, 1206*h* and 1206*i* and a multiple holding plates 1208*a*, 1208*b*, 1208*c*, 1208*d*, 1208*e*, 1208*f*, 1208*g*, 1208*h*, 1208*i* and 1208*j*.

In accordance with an exemplary embodiment of the present invention, the multiple brace members 1206*a* and 1206*b*, 1206*c*, 1206*d*, 1206*e*, 1206*f*, 1206*g*, 1206*h* and 1206*i* are dropped through preformed slots of the upper chord member 1204 and the lower chord member 1202. The brace member 1206*a* and brace member 1206*b* are positioned in a predefined multilayered network pattern between the upper chord member 1204 and the lower chord member 1202. The brace member 1206*a* welded with holding plate 1208*a* and taken through the upper chord member 1204 so as to make holding plate 1208*a* to rest on the upper chord member 1204. The brace member 1206*b* welded with holding plate 1208*b* and taken through the lower chord member 1202 so as to make holding plate 1208*b* to rest on the lower chord member 1202.

Figure 12B:
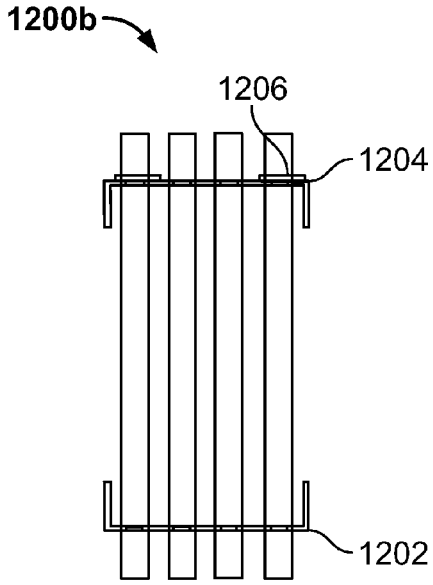
FIG. 12*b* is a diagram depicting a cross sectional views of multiple brace members welded with multiple holding plates of multilayered netlock girder system.

Referring to FIG. 12*b*, a diagram 1200*b* depicting a cross-sectional view of multiple brace members welded with multiple holding plates of multilayered netlock girder system is illustrated. In accordance with a non-limiting exemplary embodiment of the present invention, the cross-sectional view of a brace member welded with a holding plate of multilayered netlock girder system depicts a lower chord member 1202, an upper chord member 1204 and a multiple holding plates 1206.

Figure 12C:
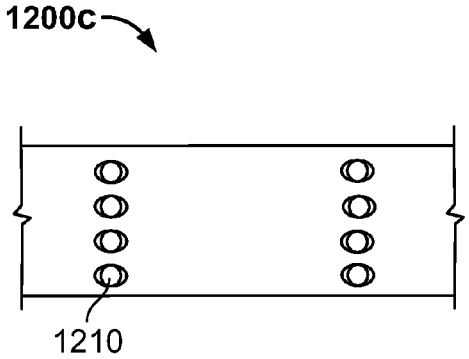
FIG. 12*c* is a diagram depicting insertion provisions on upper chord member and lower chord member of multilayered lock pattern girder system.

Referring to FIG. 12*c*, a diagram 1200*c* depicting provisions on upper chord member and lower chord member of multilayered lock pattern girder system is illustrated. In accordance with a non-limiting exemplary embodiment of the present invention, the provisions on upper chord member and lower chord member of multilayered lock pattern girder system depicts multiple provisions 1210. An upper chord member and a lower chord member include multiple provisions 1210 for inserting multiple brace members.

While specific embodiments of the invention have been shown and described in detail to illustrate the inventive principles, it will be understood that the invention may be embodied otherwise without departing from such principles.

The invention claimed is:

1. A multilayered girder system comprising:

a plurality of intersecting, tube-shaped brace members, said brace members intersecting at joints, each of said joints comprising a structural plate that connects intersecting, tube-shaped brace members, said structural plate including openings through which said intersecting, tube-shaped brace members pass;

an upper chord member; and a lower chord member disposed opposite to the upper chord member, the upper and the lower chord members having a plurality of insertion provisions, wherein the plurality of brace members are securely inserted into the plurality of insertion provisions on the upper and the lower chord members to configure a multilayered network pattern between the upper and the lower chord members.

2. The multilayered girder system as claimed in claim 1 further comprising a plurality of vertical members bolted to the upper chord member and the lower chord member, the vertical members having a plurality of insertion provisions for enabling a secured insertion of the plurality of brace members.

3. The multilayered girder system as claimed in claim 1, wherein the structural plate is a horizontal plate welded between the tube-shaped brace members thereby providing a gap between the tube-shaped brace members.

4. The multilayered girder system as claimed in claim 1, wherein the structural plate is a vertical plate welded between the tube-shaped brace members thereby providing a gap between the tube-shaped brace members.

5. The multilayered girder system as claimed in claim 1, wherein the structural plate includes a horizontal plate and a vertical plate welded between the tube-shaped brace members thereby providing a gap between the tube-shaped brace members.

6. The multilayered girder system as claimed in claim 1, wherein the openings in the structural plate comprises semi-elliptical insertion provisions for enabling mechanical coupling of the tube-shaped brace members to the structural plate.

7. The multilayered girder system as claimed in claim 1, wherein the openings in the structural plate comprises elliptical insertion provisions for enabling mechanical coupling of the tube-shaped brace members to the structural plate.

8. The multilayered girder system as claimed in claim 1, wherein at least one joint further comprises a rotatable interlock for coupling the tube-shaped brace members thereby enabling rotation of the tube-shaped brace members.

9. The multilayered girder system as claimed in claim 1, wherein the plurality of insertion provisions are capable of receiving multiple brace insertions bolted to the upper and the lower chord member to securely lock the brace member inserted into the multiple brace insertions.

10. The multilayered girder system as claimed in claim 1, further comprising a bolted tie rod passing through a brace member received within one of a multiple brace insertion, and bolted to the upper chord member and the lower chord member to lock the brace member in a position.

11. A multilayered girder system, comprising:

a plurality of intersecting, tube-shaped brace members;

an upper chord member;

a lower chord member disposed opposite to the upper chord member, the upper and the lower chord members having a plurality of preformed slots; and a plurality of structural plates having openings through which said intersecting, tube-shaped brace members pass whereby the plurality of structural rest on the upper and the lower chord members, wherein the plurality of intersecting, tube-shaped brace members pass through the preformed slots of upper and the lower chord members and are fitted welded to the plurality of structural plates to configure a multilayered network pattern between the upper and the lower chord members.

* * * * *